United States Patent [19]

Tarpley, Jr.

[11] 4,118,797

[45] Oct. 3, 1978

[54] ULTRASONIC EMULSIFIER AND METHOD

[75] Inventor: William B. Tarpley, Jr., West Chester, Pa.

[73] Assignee: Energy and Minerals Research Co., Kennett Square, Pa.

[21] Appl. No.: 845,177

[22] Filed: Oct. 25, 1977

[51] Int. Cl.[2] ..... B01F 11/02

[52] U.S. Cl. ..... 366/127

[58] Field of Search ..... 366/127, 348, 600, 114, 366/124, 145, 162

[56] References Cited

U.S. PATENT DOCUMENTS

| | | | |
|---|---|---|---|
| Re. 29,161 | 3/1977 | Duthion | 366/114 |
| 3,165,299 | 1/1965 | Balamuth | 366/127 |
| 3,245,892 | 4/1966 | Jones | 366/127 X |
| 3,997,145 | 12/1976 | Benson | 366/127 |
| 4,071,225 | 1/1978 | Holl | 366/127 |

*Primary Examiner*—Edward J. McCarthy
*Attorney, Agent, or Firm*—Seidel, Gonda & Goldhammer

[57] ABSTRACT

Liquids which are normally immiscible and which are to be emulsified are simultaneously directed through a chamber containing a source of vibratory energy. One of said liquids may contain suspended solid particles. The particles when present are comminuted and cavitation is induced in said liquids while they are in the chamber by contact with the resonant vibration-transmitting member.

11 Claims, 5 Drawing Figures

FIG. 1
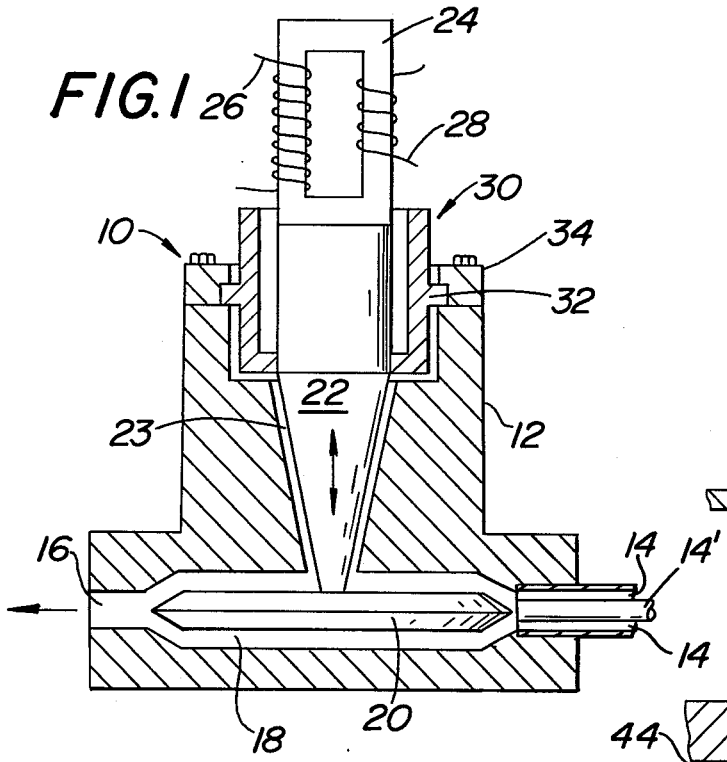
FIG. 2
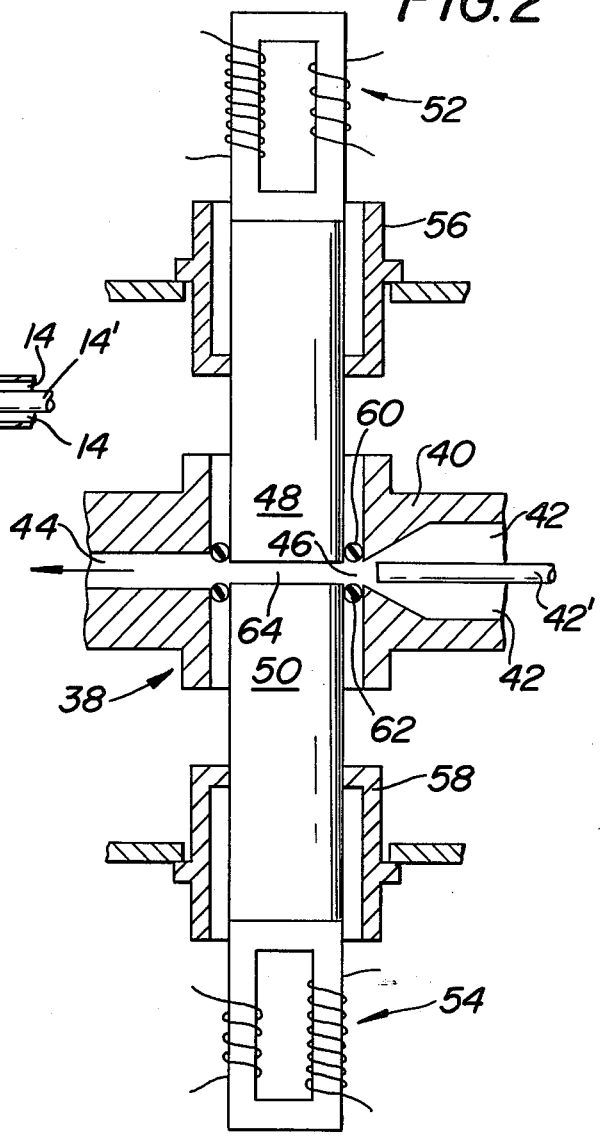
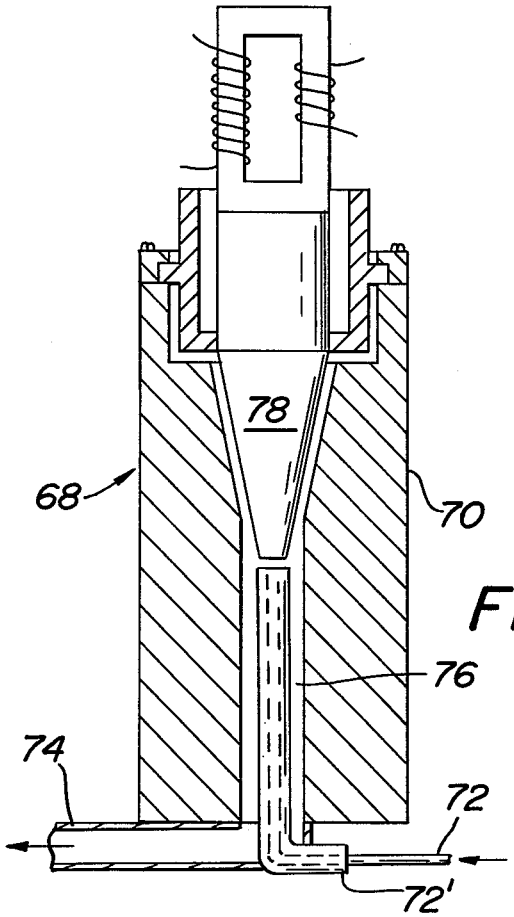
FIG. 3

FIG. 4
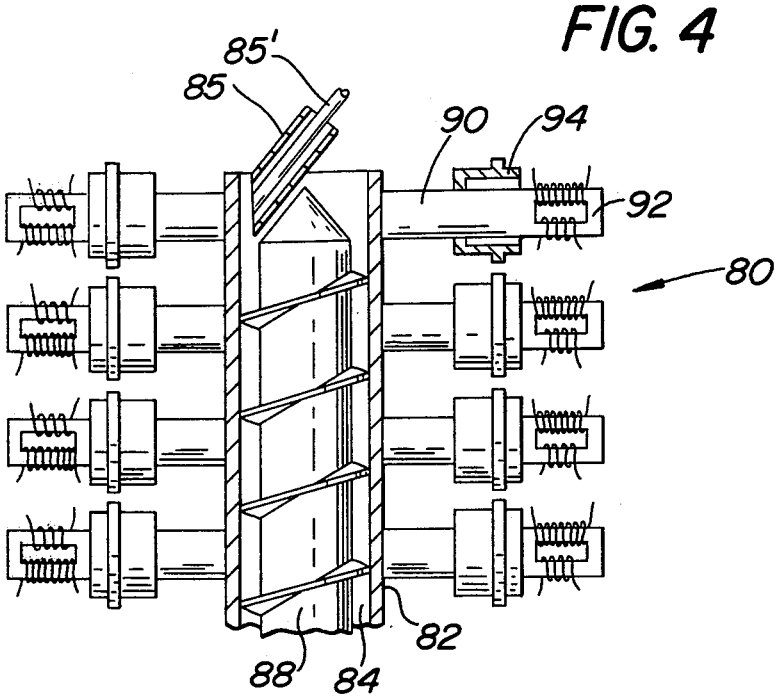
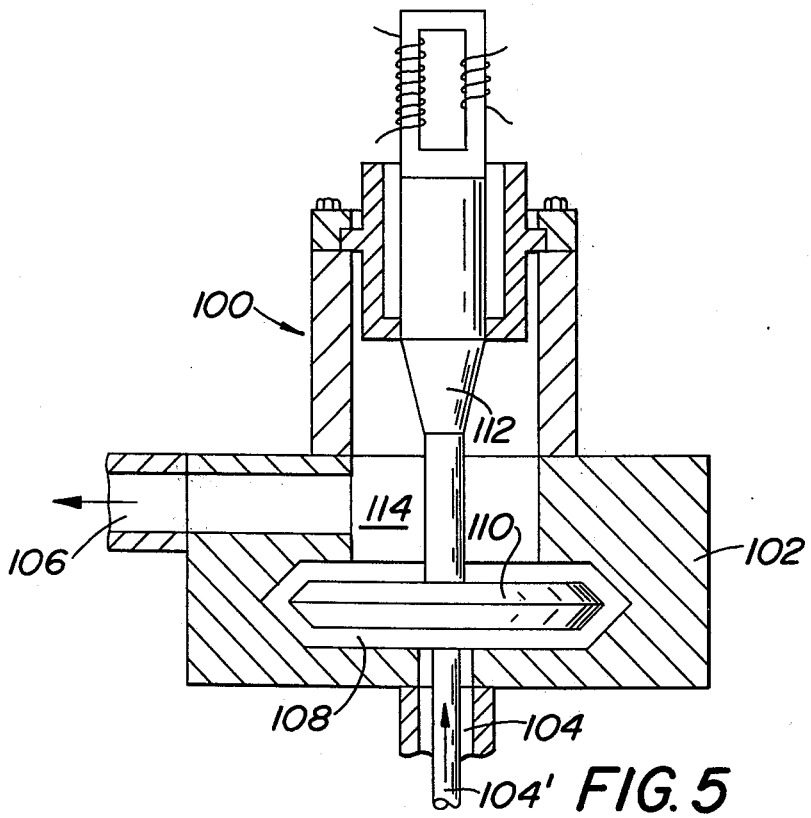
FIG. 5

ULTRASONIC EMULSIFIER AND METHOD

BACKGROUND

Emulsions are stable dispersions of microscopically visible droplets of one liquid or semi-solid substance in another liquid or semi-solid substance with which it is immiscible. Suspended solid particles may be present in either or both of the liquids and/or semi-solid substances. A recent resurgence of interest in emulsification has derived out of the findings that a small proportion of water or alcohol dispersed in oil will burn with higher efficiency and lower production of air pollutants than will the pure liquid fuel oil or gasoline.

It is possible to burn mixtures of gasoline and alcohol in internal combustion engines and it is also possible to burn these mixtures in furnaces for heating and power generation. However, alcohol and oil are immiscible and it is necessary to emulsify these two fuels into a stable emulsion in order to achieve satisfactory operation of existing units. Alcohol, of course, is a renewable resource which can be made available in large quantity from industrial fermentation of agricultural residues and the like.

Creating emulsions by sonic or ultrasonic waves is known per se. For example, see U.S. Pat. No. Re. 29,161. The device as disclosed in said patent is not conducive to large flow rates. For example, said patent refers to a flow rate on the order of about 80 liters per hour. Adequate attention has not been given by previous experimenters to the effects of standing waves in ultrasonic fields which are able to cause agglomeration of droplets which have already been dispersed and to the need for initially creating a large interfacial surface and then using ultrasonics to disrupt this created surface into many, many fine droplets. There is a need for an emulsifier operable in the sonic or ultrasonic range but capable of handling large throughputs including materials which may include a slurry and without the need for premixing the materials.

SUMMARY OF THE INVENTION

Materials to be emulsified are directed through a chamber and emulsified by cavitation induced in the materials while the materials are moving through the chamber by contact with a resonant vibration-transmitting member.

The vibration-transmitting member induces cavitation in the materials. Said member is positioned in the chamber so that there are no inactive regions of vibratory energy through which the materials can flow. Said member and its source of vibratory energy are connected to a support outside the chamber by a force-insensitive mount which minimizes loss of vibratory energy to the support.

It is an object of the present invention to provide novel apparatus and method for sonic or ultrasonic emulsifying of materials in a manner which increases the throughput efficiency while avoiding the necessity for premixing, high pressures, high shear mechanical mixing.

It is another object of the present invention to provide a novel method and apparatus for emulsifying coal and other fuels.

Other objects will appear hereinafter.

For the purpose of illustrating the invention, there are shown in the drawings forms which are presently preferred; it being understood, however, that this invention is not limited to the precise arrangements and instrumentalities shown.

FIG. 1 is a sectional view through apparatus in accordance with the present invention.

FIG. 2 is a sectional view through another embodiment of apparatus in accordance with the present invention.

FIG. 3 is a sectional view through apparatus in accordance with another embodiment of the present invention.

FIG. 4 is a sectional view through apparatus in accordance with another embodiment of the present invention.

FIG. 5 is a sectional view through apparatus in accordance with another embodiment of the present invention.

Referring to the drawings in detail, wherein like numerals indicate like elements, there is shown in FIG. 1 apparatus in accordance with one embodiment of the present invention designated generally as 10.

The apparatus 10 includes a housing 12 preferably made of a plurality of components bolted together, and without illustrating the parting line of such components. Housing 12 is made from any suitable non-corrodable material such as plastic, ceramic, and metal such as stainless steel. Housing 12 has an inlet passage 14' whose width is substantially greater than its height and sandwiched in between two similarly shaped inlet passages 14. Said inlet passages and an outlet passage 16 communicate with an elongated chamber 18 in housing 12. An enlongated disk 20 resonant in a flexural mode and having an antinode at a sharp peripheral edge is supported within the chamber 18 spaced from the walls defining the chamber 18 and adjacent said inlet passages. The length of the disk 20 is preferably substantially equal to the length of the chamber 18. At an antinode, the center of disk 20 is metallurgically bonded, such as by welding, to one end of a vibration-transmitting member 22 with a good impedance match. The presence of an antinode at the center and periphery of disk 20 accentuates the extent of vibratory energy transmitted to the materials to be emulsified. The member 22 is made of metal, is preferably resonant in a longitudinal mode, and preferably has a tapered surface exposed to chamber 18 as shown. The end of member 22, remote from the disk 20, is fixedly secured to a transducer 24 with a good impedance match such as by welding or brazing.

The transducer 24 may comprise a laminated core of nickel or other magnetostrictive material having a rectangularly shaped opening therein. A polarizing coil 28 is wound through the opening on one side thereof and an excitation coil 26 is wound through the opening on the opposite side thereof. Upon variation of the magnetic field strength of the excitation coil 26, there will be produced concomitant variants in the dimensions of the transducer 24, provided that the polarizing coil 28 is charged to a suitable level with DC current, and that the frequency of the aforesaid variations will be equal to the frequency of the alternating electric current flowing in coil 26. Other types of transducers may be used in place of magnetostrictive transducers, such as electrostrictive ceramic wafers which are commercially available.

Member 24 is preferably provided with a force-insensitive mount 30. The mount 30 facilitates supporting the member 24 and its source of vibratory energy on the housing 12 with little or no loss of vibratory energy into the housing 12.

Per se, a force-insensitive mount is known. For example, see U.S. Pat. No. 2,891,178. A force-insensitive mount is a resonant member having a length equivalent to an even multiple of one-quarter wave lengths of the material of which it is made at the frequency of operation of the source to which it is attached. One end of the mount 30 is fixedly secured to member 22 at an antinode thereon with the other end being free from attachment. At an odd multiple of the equivalent of one-quarter wave length of the frequency of operation, the mount has a flange 32 extending radially outwardly. The flange 32 is supported by the housing 12 and clamped by a ring 34 which can be bolted to the housing 12 to form a seal.

A number of different flowable materials can be emulsified such as fuel oil and water; a slurry of coal, water and fuel oil; food products such as mayonnaise, alcohol and a liquid fuel such as gasoline or fuel oil; cosmetics; agricultural products; paints; polishes; pharmaceuticals; etc. For purposes of illustration, the materials to be emulsified as described hereinafter will be referred to as an aqueous slurry of comminuted solid particles of fuel such as coal or bagasse as one component which is to be suspended in a liquid fuel which is the other component. Thus, a liquid such as fuel oil is pumped through inlet 14' into chamber 18. Simultaneously, a slurry of a liquid such as water and containing comminuted coal particles is pumped through inlet passage 14 into chamber 18. There is no premixing of the slurry and fuel oil. As the slurry and fuel oil pass through chamber 18, the vibration of disk 20 creates cavitation, interfacial disruption, and microstreaming in the slurry and fuel oil. In addition, the coal may be further comminuted. As is well known, ultrasonic cavitation creates bubbles at the liquid-liquid interface and at the coal-liquid interface which implode. The dual action of mechanical contact with the disk 20 and the cavitation in the slurry comminutes the coal and also disperses droplets of water and other liquids present containing suspended particles of coal in the fuel oil.

The vibratory power needed must be in excess of that required to induce cavitation in the materials and varies with the liquid involved, the frequency of vibration, and the temperature of the liquid. The threshold power needed to induce cavitation in water at room temperature is between 0.2 and 2 watts/cm$^2$ with a frequency of vibration between 1000 and 100,000 cps. The cavitation scrubs the surface of the coal to break up surface film, the impact of the bubbles fragments the surface of the coal, and increases the rate of diffusion of the liquid into and out of the coal. Such fragmentation and diffusion is facilitated by the fact that coal is very porous. Such scrubbing and fragmentation expedites emulsification of materials involved.

The liquid used to form the slurry with coal is preferably an aqueous liquid which may include a penetrant for inducing fracture of the coal. Typical penetrants which may be used include ammonia and methanol, tetralin, o-cyclohexyl phenol, ethanolamine, pyridine, acrylonitrile, liquid sulfur dioxide, and surfactants. Such liquids penetrate into the coal and augment fracture of the coal, and may be referred to as embrittling agents.

The embrittling agent renders the coal more susceptible to communition. If desired, the slurry may include a surfactant, grinding aid or separating aide such as Cabosil, sodium silico aluminate, and the like which prevent the coal particles from reaglomerating. Surfactants such as sorbitan oletate and its mixtures with polyoxyethylenesorbitan oleate may be added in order to increase the ease of emulsification and the stability of the emulsions as formed. High production rates are achieved due to the continuous flow of materials through the chamber 18.

The manner in which an aqueous slurry of coal is formed is old and well known to those skilled in the art since coal has for many years been transported from one place to another in the form of a slurry. A suitable slurry may be made by mixing the following with the portions being designations by weight: coal — 1% to 70% with size from powder to ¼ inch; liquid — remainder.

The transducer 24 preferably operates in a frequency range of 1000 Hertz to 20,000 Hertz. It is preferable to have a source of energy which is in the ultrasonic range since the frequency of vibration is above the audible range which is generally considered to be 14,000 Hertz.

In FIG. 2, there is illustrated another embodiment of the present invention wherein the apparatus is designated generally as 38. Apparatus 38 includes a housing 40 having coaxial inlet passages 42, 42', an outlet passage 44, each communicating with a chamber 46. Chamber 46 is preferably cylindrical. First and second vibration-transmitting members 48 and 50 enter the chamber 46 with their free end being an antinode. Members 48 and 50 are resonant in a longitudinal mode and otherwise are the same as member 22 except for the fact that they are not tapered at their free end which are antinodes. The members 48, 50 are spaced from one another by a gap 64 which may be varied from ⅛ inch to 1 inch.

Member 48 is provided with a source of vibratory energy 52 corresponding to the source shown in FIG. 1 and has a force-insensitive mount 56 corresponding to the mount 30. Member 50 has a similar source of vibratory energy 54 and a force-insensitive mount 58. The members 48 and 50 are preferably 180° out of phase so that the field in gap 64 is alternatively compressed and expanded to the point of cavitation. A seal 60 is provided between housing 40 and member 48. A similar seal 62 is provided between housing 40 and member 50. The seals may be O rings of a polymeric plastic material. If desired, the mounts 56, 58 may be sealed to housing 40 thereby eliminating seals 60, 62. Housing 40 is preferably made from the materials set forth above. Apparatus 38 operates in the same manner as described above in connection with apparatus 10.

In FIG. 3, there is illustrated another embodiment of the apparatus of the present invention designated generally as 68. Apparatus 68 is the same as apparatus 10 except as will be made clear hereinafter. In apparatus 68, the housing 70 is provided with coaxial inlet passages 72, 72' and an outlet passage 74 each of which communicate with the chamber 76. The vibration-transmitting member 78 terminates in a free end face having an antinode spaced from and closely adjacent to the discharge point of the slurry from passage 72.

Referring to FIG. 4, there is illustrated another embodiment of the present invention designated generally as 80. The apparatus 80 includes a housing 82 which is resonant in a radial mode and having a chamber 84 therein. In chamber 84, there is provided a shaft 88 having a helical screw flight to develop macro-mixing. A slurry and fuel oil are introduced into the housing 82 by way of separate concentric conduits 85, 85'.

The housing 82 is provided with a plurality of sources of vibratory energy extending radially outwardly there-from and which are tuned to drive housing 82 in a radial mode. Each source includes a vibration-transmitting member 90 having one end connected to housing 82 with a good impedance match and having its other end connected to a transducer 92. Each member 90 is provided with a force-insensitive mount 94. Each of the mounts 94 are supported by a stationary frame not shown. The materials to be emulsified discharge through coaxial conduits 85, 85' and flow downwardly through chamber 84, are subjected to mechanical forces by the screw flight on shaft 88. Cavitation is induced into the materials by the resonant vibrations of housing 82. The shaft 88 avoids an inactive region of vibration energy from developing in the center of chamber 84. Shaft 88 may be stationary but preferably is rotated slowly about its longitudinal axis by a motor not shown. If desired, shaft 88 may be resonant and vibrated in a radial mode.

In FIG. 5, there is illustrated apparatus 100 in accordance with another embodiment which is identical with apparatus 10 except as set forth hereinafter. The apparatus 100 includes a housing 102 preferably made of a plurality of components bolted together, and without illustrating the parting line of such components. Housing 102 is made from any suitable non-corrodable material such as plastic, ceramic, and metal such as stainless steel. Housing 102 has coaxial passages 104, 104' and an outlet passage 106 communicating with a circular chamber 108. A circular disk 110 resonant in a flexural mode and having an antinode at a sharp peripheral edge is supported within the chamber 108 spaced from the walls defining the chamber 108.

The diameter of the disk 110 is preferably substantially equal to the diameter of the chamber 108. At an antinode, the center of disk 110 is metallurgically bonded, such as by welding, to one end of a vibration-transmitting member 112 with a good impedance match. The presence of an antinode at the center and periphery of disk 110 accentuates the extent of vibratory energy transmitted to the materials. The member 112 is made of metal, is preferably resonant in a longitudinal mode, and preferably is tapered as shown. A chamber 114 communicates chamber 108 with outlet passage 106. Member 112 extends through the chamber, is coaxial therewith, and has an antinode exposed to the slurry in chamber 114. The materials to be emulsified flow from inlet passages 104, 104', through chamber 108, around disk 110 to chamber 114, and then to outlet passage 106.

When an ultrasonic wave is transmitted into a medium, the wave can be reflected from a wall, interface or the like. The reflected wave can combine with transmitted waves to thereby form standing waves. A standing wave pattern is to be avoided in the materials to be emulsified since such standing waves reduce efficiency, are energy losses since they attenuate the ultrasonic signal, and they cause recoalescence of the emulsified materials.

The various embodiments of the present invention are designed to avoid or minimize the formation of a standing wave in the material to be emulsified. In FIG. 1, standing waves are avoided since disk 20 vibrates in flexure thereby causing reflected waves to zig-zag instead of combining with transmitted waves. In FIG. 2, substantially the entire chamber is defined by the active region at the end faces of members 48, 50 thereby inhibiting formation of standing waves. The structural arrangement in the other embodiments have a similar effect except for apparatus 68 wherein a small standing wave pattern of no consequence can form at the extreme upper end of chamber 76 adjacent the force-insensitive mount.

Each of the embodiments described above is structurally interrelated so that the materials to be emulsified cannot avoid the active area of vibratory energy. In each embodiment, the materials are exposed to a large surface area of the vibratory member as compared with the area of the chamber through which the materials can flow. For example, the exposed surface area of members 22 and 78 greatly exceeds the cross-sectional areas of said members and also exceeds the cross-sectional area of the chamber through which the materials can flow. Also, in each embodiment, there are successive or progressive regions of vibratory energy with which the materials comes into contact. In the embodiments of FIGS. 1 and 3–5, the change in direction of flow creates turbulence which supplements the turbulence resulting from cavitation. The vibration-transmitting member may be resonant in a wide variety of modes including longitudinal, radial, peristaltic and torsional.

The present invention may be embodied in other specific forms without departing from the spirit or essential attributes thereof and, accordingly, reference should be made to the appended claims, rather than to the foregoing specification as indicating the scope of the invention.

I claim:

1. A method of emulsifying flowable immiscible materials comprising simultaneously directing the materials to be emulsified through a chamber, emulsifying said materials by inducing cavitation in the materials while said materials are moving through said chamber by contacting said materials with an active region of at least one resonant vibration-transmitting member, positioning said member in said chamber so that there are no inactive regions of vibratory energy through which the materials can flow and so that the materials enter said chamber adjacent said active region, inhibiting the formation of a standing wave in at least a major portion of the flowable materials flowing through said chamber, supporting said member and a source of vibratory energy connected thereby by a mount which minimizes loss of vibratory energy to the support.

2. A method in accordance with claim 1 including using a liquid fuel as one of the materials to be emulsified.

3. A method in accordance with claim 2 including using a slurry which includes suspended particles of coal as one of the materials to be emulsified.

4. A method in accordance with claim 1 wherein said resonant vibration-transmitting member has at the active region at least one antinode exposed within said chamber and is resonant in a mode selected from the group consisting of longitudinal, radial, torsional, peristaltic, and flexural modes.

5. A method in accordance with claim 1 wherein said vibration-transmitting member includes a disk resonant in a flextural mode with an antinode at its periphery.

6. A method in accordance with claim 1 wherein said resonant vibration-transmitting member has an exposed surface area in said chamber which exceeds the cross-sectional area of the chamber through which said materials can flow.

7. A method of emulsifying solid particles of coal comprising:

(a) forming a slurry which includes coal particles, (b) pumping the slurry and a liquid to be emulsified through separate conduits, simultaneously introducing said slurry and liquid into a chamber having an inlet spaced from an outlet, inducing cavitation in said slurry and liquid while said slurry and liquid are moving through said chamber by contact with a resonant vibration-transmitting member in said chamber, positioning said member in said chamber so that there are no inactive regions of vibratory energy through which the slurry and liquid can flow between said inlet and outlet, inhibiting the formation of a standing wave in at least a major portion of said slurry and liquid, supporting said member by a mount outside said chamber and which minimizes loss of vibratory energy to the support.

8. A method in accordance with claim 7 including creating turbulence in said chamber wherein the turbulence at least in part is due to a change in direction of the slurry and liquid as they move through the chamber.

9. A method in accordance with claim 7 including using a fuel as the liquid in which the slurry is to be dispersed.

10. Apparatus for emulsifying materials comprising a housing having a chamber provided with concentric inlet through which materials to be emulsified may be introduced into the chamber, said chamber having an outlet through which the materials may flow, means for emulsifying materials by inducing cavitation in the materials while the materials move through the chamber, said means including a resonant vibration-transmitting member having at least one antinode exposed in said chamber so that there are no inactive regions of vibratory energy directly from the inlet to the outlet and through which the materials can flow, said vibration-transmitting member being connected to a support outside said housing by way of a mount that minimizes loss of vibratory energy to the support, and the surface area of said vibration-transmitting member exposed in said chamber being greater than the cross-sectional area of the chamber through which the materials can flow.

11. Apparatus in accordance with claim 10 wherein said vibration-transmitting member is resonant in a mode selected from the group consisting of flextural, longitudinal, torsional, peristaltic, and radial modes.

* * * * *